US007035577B2

(12) United States Patent
Katoh et al.

(10) Patent No.: US 7,035,577 B2
(45) Date of Patent: Apr. 25, 2006

(54) DEVELOPING APPARATUS, IMAGE FORMING APPARATUS AND TONER REPLENISHING METHOD

(75) Inventors: Atsuyuki Katoh, Tenri (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 102 days.

(21) Appl. No.: 10/741,765

(22) Filed: Dec. 19, 2003

(65) Prior Publication Data

US 2004/0131394 A1 Jul. 8, 2004

(30) Foreign Application Priority Data

Dec. 20, 2002 (JP) ..... P2002-370960

(51) Int. Cl.
*G03G 15/08* (2006.01)

(52) U.S. Cl. ..... 399/281; 399/285; 399/291

(58) Field of Classification Search ..... 399/252, 399/258, 265, 266, 279, 281, 285, 270, 290, 399/291
See application file for complete search history.

(56) References Cited

U.S. PATENT DOCUMENTS

| | | | | |
|---|---|---|---|---|
| 6,023,600 | A * | 2/2000 | Julien et al. | 399/266 |
| 6,327,452 | B1 * | 12/2001 | Jaskowiak et al. | 399/286 |
| 6,472,115 | B1 | 10/2002 | Uezono et al. | 430/102 |
| 6,829,448 | B1 * | 12/2004 | Ozawa et al. | 399/55 |

FOREIGN PATENT DOCUMENTS

| | | |
|---|---|---|
| JP | 2-199484 | 8/1990 |
| JP | 2001-277594 | 10/2001 |

* cited by examiner

*Primary Examiner*—Hoan Tran
(74) *Attorney, Agent, or Firm*—George W. Neuner; Edwards Angell Palmer & Dodge LLP

(57) ABSTRACT

The invention provides a developing apparatus, an image forming apparatus and a toner replenishing method that can restrain deterioration of toner and can stably form high quality image. Replenishing bias voltage is applied to a developing roller and a replenishing roller to charge conductive toner kept on a surface of the replenishing roller to a predetermined amount of charge. By electric field generated between the developing roller and the replenishing roller on the basis of the applied replenishing bias voltage, charged conductive toner is made fly and replenished from the replenishing roller to the developing roller. An appropriate amount of conductive toner is kept in a toner transporting body formed on a surface of the developing roller and is supplied to a photoconductor roller.

19 Claims, 6 Drawing Sheets

DEVELOPING APPARATUS, IMAGE FORMING APPARATUS AND TONER REPLENISHING METHOD

BACKGROUND OF THE INVENTION

1. Field of the Invention

The present invention relates to a developing apparatus which makes a toner adhere to a photoconductor and according to more detailed description, the present invention relates to a developing apparatus which makes conductive toner charged and makes the charged toner adhere to the photoconductor and also relates to an image forming apparatus provided with the developing apparatus and a toner replenishing method.

2. Description of the Related Art

According to outline of a process of forming an image of an image forming apparatus such as a printer or a copying machine or the like, toner charged in an apparatus housing the toner in advance is made adhere to an electrostatic latent image formed on a surface of a photoconductor roller by using a developing roller located close to the photoconductor roller and thereby developing is performed and a toner image which becomes an apparent image is transferred to a printing sheet and is fixed and thereby printing is performed on a recording sheet.

Therefore, it is required that toner should be in advance charged on the occasion of printing on the recording sheet. Consequently, when insulating toner is used, for instance, charge control material is mixed with the toner in the apparatus housing toner by using a stirring blade or the like and friction is applied to the toner and the charge control material and the toner is charged.

However, when friction is applied to the toner and the charge control material by stirring them, there are problems that the toner and the charge control material are segregated and separated from each other without being sufficiently mixed with each other and the toner deteriorates by friction stress.

Consequently, technique for using the conductive toner instead of the insulating toner is proposed.

When the conductive toner is used, the surface of the photoconductor roller and the surface of the developing roller are located without touch with each other so that a predetermined distance can be given between these surfaces. And when voltage is applied to a position between the surface of the photoconductor roller and the surface of the developing roller, the conductive toner on the developing roller is charged and is moved to the photoconductor roller and adheres to the electrostatic latent image.

The following description is given about a developing apparatus in Japanese Unexamined Patent Publication JP-A 2- 199484 (1990) as a prior art for performing developing.

As shown in FIG. 10, this image forming apparatus 100 is provided with a toner transporting body (developing roller) 102 supplying toner to a latent image carrier (photoconductor roller) 101, a sleeve (replenishing roller) 103 and a blade 104 regulating a thickness of a layer of the toner supplied to the toner transporting body. The toner transporting body is configured with an insulating layer coated on a surface of the roller shape conductive support.

Voltage is respectively applied to a position between the conductive support of the toner transporting body and the sleeve 103 and to a position between the sleeve 103 and the blade 104 of the toner transporting body from voltage applying means 105. In addition, voltage is applied to a position between the conductive support of the toner transporting body and the latent image carrier by developing bias applying means 106.

Conductive toner is successively supplied from the sleeve to the toner transporting body and from the toner transporting body to the latent image carrier by using the above mentioned configuration.

A sensor located in the developing apparatus detects temperature and humidity or the like and an amount of toner which will be developed is kept constant by changing electric field between the conductive support and the blade according to a result of detecting the temperature and the humidity or the like.

In addition, the following description is given about an image forming apparatus in Japanese Unexamined Patent Publication JP-A 2001-277594 (2001) as another prior art with use of conductive toner.

This image forming apparatus forms an image by exposing a photoconductor filled with charged optical conductive toner from a back surface of the photoconductor and inverting polarity of the toner and making the toner fly on a side of an optical recording medium.

Using the optical conductive toner prevents diffusion of electric charge in an orthogonal direction to a flying direction equal to a plane direction of the photoconductor for the toner before flying at the time of exposing the toner to restrain deterioration of resolution.

In a developing apparatus in Japanese Unexamined Patent Publication JP-A 2-199484 (1990), supplying toner from the toner transporting body to the latent image carrier is performed without being in contact with each other, but supplying the toner from the sleeve to the toner transporting body is performed with being in contact with each other and therefore there is occurrence of mechanical stress for toner sandwiched between the sleeve and the toner transporting body and the toner deteriorates. In addition, driving torque given between the sleeve and the toner transporting body becomes greater and an amount of consumption of driving power increases.

In an image forming apparatus in Japanese Unexamined Patent Publication JP-A 2001-277594, when toner having electric charge is made fly, electrostatic repulsion is caused by each toner and when toner reaches the recording medium, the toner is diffused in a direction of the surface of the photoconductor and resolution deteriorates. In addition, this image forming apparatus uses exposure on a back of a belt, but in this case, since an exposing apparatus is located in a photoconductor roller, there is occurrence of problems that the image forming apparatus becomes large and complicated. Furthermore, there is also a problem that optical conductive toner has restriction in composition component in comparison with conductive toner and thereby handling the optical conductive toner is bothersome and the image forming apparatus requires cost.

SUMMARY OF THE INVENTION

An object of the invention is to provide a developing apparatus and an image forming apparatus and a toner replenishing method enabling a high quality image to be stably formed by preventing deterioration of toner.

The invention provides a developing apparatus comprising:

a developing portion for supplying conductive toner to a photoconductor portion in which an electrostatic latent image is formed; and a replenishing portion for replenishing the conductive toner stored in a developing container to the developing portion, the photoconductor portion and the developing portion as well as the developing portion and the replenishing portion being relatively moved, wherein the developing portion and the replenishing portion are located at a predetermined interval without being in contact with each other, wherein the developing apparatus is provided with a replenishing bias portion for applying replenishing bias voltage to the developing portion and the replenishing portion, and wherein when the replenishing bias portion applies replenishing bias voltage, conductive toner kept on a surface of the replenishing portion is charged and then the charged conductive toner moves from the replenishing portion to the developing portion by electric field generated between the developing portion and the replenishing portion to be replenished.

According to the invention, the replenishing portion replenishes conductive toner stored in the developing container to the developing portion and the developing portion supplies the replenished conductive toner to the photoconductor portion in which an electrostatic latent image is formed. The developing portion and the replenishing portion are located at a predetermined interval without being in contact with each other and the replenishing bias portion applies replenishing bias voltage to the developing portion and the replenishing portion. In addition, It is preferable that an interval between the developing portion and the replenishing portion is apploximately 100 μm. In addition, It is preferable that the replenishing bias voltage is set to, for instance approximately −600 V.

When the replenishing bias portion applies replenishing bias voltage, first the conductive toner kept on a surface of the replenishing portion is charged, the charged conductive toner is moved from the replenishing portion to the developing portion by electric field arising on a position between the developing portion and the replenishing portion.

Since this enables electric charge to be applied to the conductive toner by the replenishing bias in comparison with a case in which toner is stirred and charged by friction, deterioration of the toner can be prevented. In addition, since the developing portion and the replenishing portion are located without being in contact with each other, torque for driving the developing portion and the replenishing portion respectively can be made small and power consumption can be reduced.

In addition, since the charged conductive toner is moved by the electric field generated by the replenishing bias voltage, the conductive toner having no variation in an amount of charge can be supplied and therefore stable developing action can be realized.

In addition, In the invention it is preferable that the replenishing portion is provided with electric charge amount adjusting means for adjusting an amount of electric charge which is supplied to the conductive toner.

According to the invention, the electric charge amount adjusting means adjusts an amount of electric charge which is supplied to the conductive toner in the supplying portion.

This enables dispersion in an amount of charge of the conductive toner to be eliminated and also enables overcharge caused by rapid movement of an electric charge to the conductive toner to be prevented and also enables time constant to be used on the occasion of supplying an amount of electric charge to the conductive toner to be set.

In addition, in the invention it is preferable that the electric charge amount adjusting means is made of a resistance layer.

According to the invention, the electric charge amount adjusting means is made of a resisting layer.

This enables the electric charge amount adjusting means to be realized by using simple configuration. In other words, this enables current generated by moving the conductive toner on a position between the developing portion and the replenishing portion for predetermined replenishing bias voltage to be controlled by using the resistance layer having desired resistance. In addition, it is sufficient that the resistance layer is a resistance layer using a general conductive agent such as carbon black, metal oxide and ion conductive agent.

In addition, in the invention it is preferable that the developing apparatus further comprises vibrating means for vibrating the conductive toner kept in the replenishing portion.

According to the invention, the vibrating means vibrates the conductive toner kept in the replenishing portion. This enables conductive toner adhering to another conductive toner by intermolecular force or the like to be easily disassociated from each other and enables movement of conductive toner from the replenishing portion to the developing portion to be made easy and stable. In addition, the vibrating means may be means vibrating the replenishing portion mechanically by using, for instance, a piezoelectric element, a magnetic vibrator and a voice coil linear motor or the like.

In addition, in the invention it is preferable that the vibrating means is configured so as to superpose vibrating bias voltage on the replenishing bias voltage.

According to the invention, the vibrating means superposes the vibrating bias voltage on the replenishing bias voltage which the replenishing bias portion applies. In addition, the vibrating bias voltage may be, for instance, alternating voltage, voltage of a periodic function like a sine function and pulse voltage of a predetermined period.

Since this enables voltage applied on a position between the developing portion and the replenishing portion to be vibrated, a size of the electric field and an amount of charge of the conductive toner are enabled to be vibrated and the conductive toner kept in the replenishing portion is enabled to be vibrated. Consequently, vibrating means can be realized by using simple configuration.

In addition, the vibrating bias voltage is preferably pulse voltage with 10% duty on 1 $KV_P$ in 2.5 kHz period to restrain increase of the whole discharging current followed by alternating current superposition or increase of ozone. Ten percent of the vibrating bias voltage gives vibrating power for movement of the conductive toner and simultaneously remaining ninety percent of the vibrating bias voltage restrains occurrence of ozone.

In addition, in the invention it is preferable that the developing portion is provided with a concave portion formed on the whole surface of the developing portion and keeps the conductive toner moved from the replenishing portion in the concave portion and supplies the conductive toner to the photoconductor portion.

According to the invention, the developing portion is provided with a concave portion formed on the whole surface of the developing portion and keeps the conductive toner moved from the replenishing portion in the concave portion and supplies the kept conductive toner to the photoconductor portion.

This enables an amount of supplying the conductive toner and a particle diameter of the conductive toner to be controlled depending on a shape of the concave portion. The shape of the concave portion includes, for instance, width and depth of the concave portion and an interval from an adjoining concave portion or the like. Values of the width and the depth of the concave portion may be respectively the same for all concave portions and may be respectively different for each concave portion. In addition, it is preferable that depth of a concave portion is approximately 20 μm to 40 μm.

In addition, location of a concave portion is not restricted to linear or curved location at a predetermined interval and may be in a state of a point or a predetermined pattern or the like. In addition, location of a concave portion is not restricted to, for instance, periodic location and may be in a state of a random pattern considered so that graininess of a print image can be restrained.

In addition, in the invention it is preferable that the concave portion is provided with a pair of grid electrodes for applying grid bias voltage generating electric field in a depth direction of the concave portion.

According to the invention, when charged toner is replenished into a concave portion, the pair of grid electrodes applies grid bias voltage and generates electric field in the depth direction of the concave portion. This electric field enables the charged conductive toner to be kept in the concave portion. Furthermore, configuration with ability of adjusting the grid bias voltage enables keeping and desorption of the conductive toner to be easily controlled.

In addition, according to the invention, electric field generated by grid bias voltage enables the charged conductive toner to be kept in the concave portion. Furthermore, configuration with ability of adjusting the grid bias voltage enables keeping and desorption of the conductive toner to be easily controlled.

In addition, in the invention it is preferable that the pair of grid electrodes includes a first electrode formed on a bottom portion of a concave portion and a second electrode exposed and formed in an area except the concave portion and grid bias voltage is applied to a position between the first electrode and the second electrode.

According to the invention, the pair of grid electrodes comprises a first electrode formed on a bottom portion of a concave portion and a second electrode exposed and formed in an area except the concave portion.

This enables a pair of grid electrodes to be easily realized.

When the conductive toner is put into contact with the exposed second electrode, the conductive toner is charged so that the conductive toner can become the same electric potential as the second electrode. At that time polarity of the conductive toner is inverted and the conductive toner is moved to the replenishing portion by electric field generated by the replenishing bias voltage. Consequently, even if the conductive toner is moved from the replenishing portion to an area except a concave portion of the developing portion, the conductive toner returns to the replenishing portion and is kept only in a concave portion.

In addition, the pair of grid electrodes can be realized as mentioned below. The first electrode is formed on the whole of surface of the developing portion and a dielectric layer is thereon formed and an insulative grid is located in a predetermined area on the dielectric layer and the second electrode is formed on an opposite side to the first electrode side. In this case, a portion between adjoining insulative grids corresponds to a concave portion. The dielectric layer formed on the first electrode is located so that electric charge of the conductive toner kept in a concave portion cannot be leaked to the first electrode of the insulative grid.

When the depth of the concave portion is approximately 20 to 40 μm, it is preferable that grid bias voltage to be applied is approximately 100 V.

In addition, in the invention it is preferable that a constant grid bias voltage is applied to the pair of grid electrodes.

According to the invention, a constant grid bias voltage is applied to the pair of grid electrodes.

This enables developing action to be more stable because electric field applied to the conductive toner kept in a concave portion by the pair of grid electrodes and an amount of charge of the toner or the like are not changed even when electric potential of either electrode of a pair of grid electrodes is changed.

In addition, in the invention it is preferable that the concave portion is arranged at a predetermined interval on the surface of the developing portion and an arrangement direction of the concave portion is tilted at a predetermined angle with respect to a moving direction of the surface of the developing portion.

According to the invention, the concave portion is arranged at a predetermined interval on the surface of the developing portion and the arrangement direction of the concave portion is tilted at a predetermined angle with respect to a moving direction of the surface of the developing portion.

This enables occurrence of a ghost pattern depending on a shape of a concave portion, for instance, in an electrostatic latent image to be restrained.

In addition, by making relative difference of speed arise between the developing portion and the photoconductor portion, a relative position of conductive toner kept in a concave portion on the occasion of moving the conductive toner is made different for each concave portion and therefore pattern made by a shape of the concave portion can be averaged and planarized.

In addition, in the invention it is preferable that the photoconductor portion is formed of a photoconductor roller which rotates around an axis line of a rotating shaft, the developing portion is formed of a developing roller which rotates around an axis line of a rotating shaft parallel to the rotating shaft of the photoconductor roller, the photoconductor roller and the developing roller are arranged at a predetermined interval without being in contact with each other, and circumferential speed of the developing roller is larger than circumferential speed of the photoconductor roller.

According to the invention, the photoconductor portion comprises a photoconductor roller which rotates around an axis line of a rotating shaft, and the developing portion comprises a developing roller which rotates around an axis line of a rotating shaft parallel to the rotating shaft of the photoconductor roller. The photoconductor roller and the developing roller are arranged at a predetermined interval without being in contact with each other, and circumferential speed of the developing roller is set to larger value than circumferential speed of the photoconductor roller.

This enables lack of an amount of the conductive toner supplied from the developing roller to the photosensitive roller to be prevented.

In addition, in the invention it is preferable that the developing apparatus is provided with a developing bias portion for applying developing bias voltage between the developing portion and the photoconductor portion, and the developing bias portion temporally makes the developing bias voltage change.

According to the invention, the developing bias applying means applies temporally changing developing bias voltage between the developing portion and the photoconductor portion.

Temporal change of developing bias voltage makes easiness of movement of the conductive toner from the developing portion to the photoconductor portion change temporally.

This makes timing of moving of the conductive toner from the developing portion to the photoconductor portion change and enables ghost pattern caused by a shape of a concave portion to be averaged and planarized.

In addition, developing bias applying means may make developing bias voltage change temporally in sine-wave shape or may also make the developing bias voltage change temporally by superposing pulse at a predetermined distance.

In addition, the invention provides an image forming apparatus comprising:

a photoconductor portion on whose surface an electrostatic latent image is formed;

a writing portion for writing the electrostatic latent image on the photoconductor portion on the basis of image data;

the above mentioned developing apparatus for supplying toner to the photoconductor portion to form a toner image;

a transfer portion for transferring the toner image on a sheet-like recording medium; and a fixing portion for fixing the transferred toner image on the recording medium.

According to the invention, when the writing portion writes an electrostatic latent image on the photoconductor portion on the basis of the image data input from an image reading portion or the like, the above mentioned developing apparatus supplies toner to the photoconductor portion to form an toner image. When the transfer portion transfers the toner image on the sheet-like recording medium, the fixing portion fixes the transferred toner image on the recording medium. The recording medium on which toner is fixed is discharged.

This enables stable developing action to be performed and enables high quality image to be formed.

In addition, the invention provides a toner replenishing method by which a replenishing portion being located at a predetermined interval without being in contact with a developing portion which supplies conductive toner to a photoconductor portion on which an electrostatic latent image is formed, replenishes conductive toner stored in a developing container to the developing portion, comprising:

applying replenishing bias voltage to the developing portion and the replenishing portion;

charging the conductive toner kept on the surface of the replenishing portion; and moving the charged conductive toner from the replenishing portion to the developing portion by electric field generated between the developing portion and the replenishing portion on the basis of the applied replenishing bias voltage to replenish.

According to the invention, the replenishing portion being located at a predetermined interval without being in contact with the developing portion which supplies conductive toner to the photoconductor portion on which an electrostatic latent image is formed, replenishes conductive toner stored in the developing container to the developing portion. When replenishing bias voltage is applied to the developing portion and the replenishing portion, the conductive toner kept on the surface of the replenishing portion is charged. The charged conductive toner moves from the replenishing portion to the developing portion by electric field generated between the developing portion and the replenishing portion on the basis of the applied replenishing bias voltage to replenish.

Since this enables electric charge to be applied to the conductive toner by the replenishing bias in comparison with a case in which toner is stirred and charged by friction, deterioration of the toner can be prevented. In addition, since the developing portion and the replenishing portion are located without being in contact with each other, torque for driving the developing portion and the replenishing portion respectively can be made small and power consumption can be reduced.

In addition, since the charged conductive toner moves by the electric field generated by the replenishing bias voltage, the conductive toner having no dispersion in an amount of charge can be supplied and therefore stable developing action can be realized.

In addition, in the invention it is preferable that the developing portion is provided with a concave portion formed on the whole surface of the developing portion and keeps the conductive toner moved from the replenishing portion in the concave portion and supplies the conductive toner to the photoconductor portion, the concave portion is provided with a pair of grid electrodes, and the pair of grid electrodes generates electric field in the depth direction of the concave portion by applying grid bias voltage so as to adjust an amount of charge of the conductive toner kept in the concave portion.

According to the invention, the developing portion is provided with a concave portion formed on the whole surface of the developing portion and keeps the conductive toner moved from the replenishing portion in the concave portion and supplies the conductive toner to the photoconductor portion.

In addition, the pair of grid electrodes provided in the concave portion generates electric field in the depth direction of the concave portion by applying grid bias voltage so as to adjust an amount of charge of the conductive toner kept in the concave portion. Charge amount of conductive toner is adjusted by injection of electric charge to the conductive toner or discharging the conductive toner.

Since this enables conductive toner whose amount of charge is adjusted and which has an appropriate amount of electric charge to be supplied, developing action can be stable.

In addition, in the invention it is preferable that the developing portion is provided with a concave portion formed on the whole surface of the developing portion and keeps the conductive toner moved from the replenishing portion in the concave portion and supplies the conductive toner to the photoconductor portion, the concave portion is provided with a pair of grid electrodes, and the pair of grid electrodes generates electric field in the depth direction of the concave portion by applying grid bias voltage so as to adjust a keeping amount of the conductive toner kept in the concave portion.

According to the invention, the developing portion is provided with a concave portion formed on the whole surface of the developing portion and keeps the conductive toner moved from the replenishing portion in the concave portion and supplies the conductive toner to the photoconductor portion.

In addition, the pair of grid electrodes provided in the concave portion generates electric field in the depth direction of the concave portion by applying grid bias voltage so as to adjust a keeping amount of the conductive toner kept in the concave portion. The keeping amount of the kept conductive toner is adjusted by injection of electric charge for the conductive toner or discharging the conductive toner and simultaneously adjusting a level and a direction of the grid bias voltage.

Since this enables an appropriate amount of conductive toner to be supplied, developing action can be stable.

In addition, in the invention it is preferable that conductive toner replenished excessively from the replenishing portion to the developing portion moves to the replenishing portion by electric field generated by the replenishing bias voltage.

According to the invention, conductive toner replenished excessively from the replenishing portion to the developing portion moves to the replenishing portion by electric field generated by the replenishing bias voltage.

Since This eliminates keeping excessive conductive toner in the developing portion, an appropriate amount of the conductive toner can be supplied and developing action can be stable.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
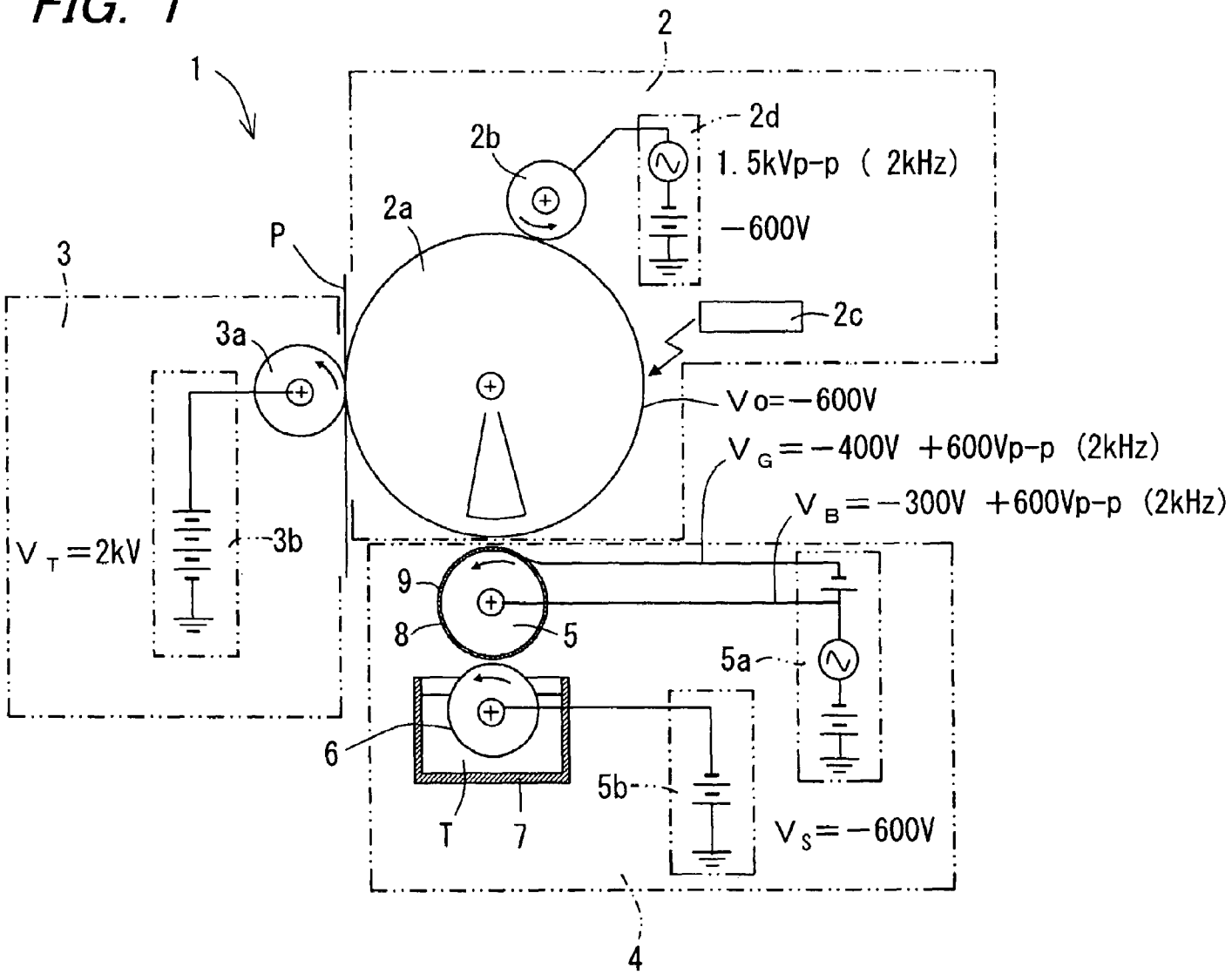
FIG. 1 is a schematic view showing configuration of an image forming apparatus according to an embodiment of the invention.

Now referring to the drawings, preferred embodiments of the invention are described below.

FIG. 1 is a schematic view showing configuration of an image forming apparatus 1 according to an embodiment of the invention. The image forming apparatus 1 is provided with a photoconductor apparatus 2, a transferring apparatus 3 and a developing apparatus 4.

The image forming apparatus 1 is furthermore a manuscript reading apparatus, a feeding apparatus, a fixing apparatus, a delivering apparatus respectively not shown.

In a process of forming an image of the image forming apparatus 1 in this embodiment, first the photoconductor apparatus 2 forms an electrostatic latent image on the basis of image data read by the manuscript reading apparatus, to which the developing apparatus 4 supplies toner T to make the electrostatic latent image to elicit as a toner image. The transferring portion transfers the toner image on a print sheet P transported from the feeding apparatus and the fixing apparatus makes fusion bond of toner and the printed print sheet P is delivered from the delivering apparatus.

The photoconductor apparatus 2 comprises the photoconductor roller 2*a*, a charging roller 2*b*, a laser unit 2*c* and a voltage applying unit 2*d*. The photoconductor roller 2*a* is a cylinder rotating at a rotating speed of $v_P$ around an axis line of an rotating shaft perpendicular to a surface of a sheet and a circumferential surface of the photoconductor roller 2*a* is a photoconductor portion coated with photosensitive resin. In addition, each of after-mentioned rollers is a similar cylinder as the photoconductor roller 2*a* and has a rotating shaft parallel to the rotating shaft of the photoconductor roller 2*a* and is rotating at a predetermined rotating speed around an axis line of the rotating shaft. The charging roller 2*b* is contact with a surface of the photoconductor roller 2*a* to set a contact area of the photoconductor roller 2*a* to a predetermined electric potential. An alternating current voltage indicating 1.5 kV between peaks (hereinafter, referred to as 1.5 $kV_{P-P}$) is applied to the charging roller 2*b* in frequency of 2 kHz by the voltage applying unit 2*d* and direct current volt of −600 V is also applied to the charging roller 2*b* and thereby the area of the photoconductor roller 2*a* being contact with the charging roller 2*b* is on average set to electric potential $V_0$=−600 V. The laser unit 2*c* which is a writing portion performs laser irradiation toward a surface of the charged photoconductor roller 2*a* as mentioned above to form an exposure portion in which electric potential is set to a value less than −50 V on the basis of image data. Aggregation of the exposure portions becomes an electrostatic latent image.

The transferring apparatus 3 comprises a transferring roller 3*a* which is a transferring portion and a voltage applying unit 3*b*. The transferring roller 3*a* pinches the print sheet P between the photoconductor roller 2*a* and the transferring roller 3*a* itself to transfer toner T adhering to the electrostatic latent image to the print sheet P. The voltage applying unit 3*b* applies a predetermined electric potential $V_T$=2 kV to the transferring roller 3*a*. In addition, the transferring roller 3*a* is set so as to rotate at a predetermined rotating speed $V_T$.

The developing apparatus 4 comprises a developing roller 5, a voltage applying unit 5*a*, a replenishing roller 6, a voltage applying unit 5*b* and a developing container 7.

The developing roller 5 is a developing portion which supplies toner T supplied from the replenishing roller 6 to the photoconductor roller 2*a*. The developing roller 5 is located at such position that a predetermined intervals can be given respectively between a surface of the developing roller 5 and a surface of the photoconductor roller 2*a* and between a surface of the developing roller 5 and a surface of the replenishing roller 6. In addition, the developing roller 5 rotates at a predetermined speed of $v_d$ in the same direction of rotating of the photoconductor roller 2*a* and in counter direction of rotating of the replenishing roller 6 as indicated by an arrow in the figure.

The replenishing roller 6 is a replenishing portion which replenishes toner T stored in the developing container 7 to the developing roller 5. The replenishing roller 6 rotates at a predetermined speed of $v_s$ in counter direction of the developing roller 5. In addition, the toner T in the present embodiment is conductive toner.

The conductive toner T used in this embodiment comprises toner which is given by melting and kneading styrene acrylic resin acting as a main resin (90.5 parts by weight)

and quaternary-ammonium salt acting as a conductive agent (3.5 parts by weight) and copper phthalocyanine blue acting as coloring agent (6.0 parts by weight) by using a double screw extrusion kneading machine to obtain solid content, crashing and then classifying the solid content. The conductive toner T has an average grain diameter of 8 μm and a volume resistance value of $3\times10^6$ (Ω·cm).

Figure 2:
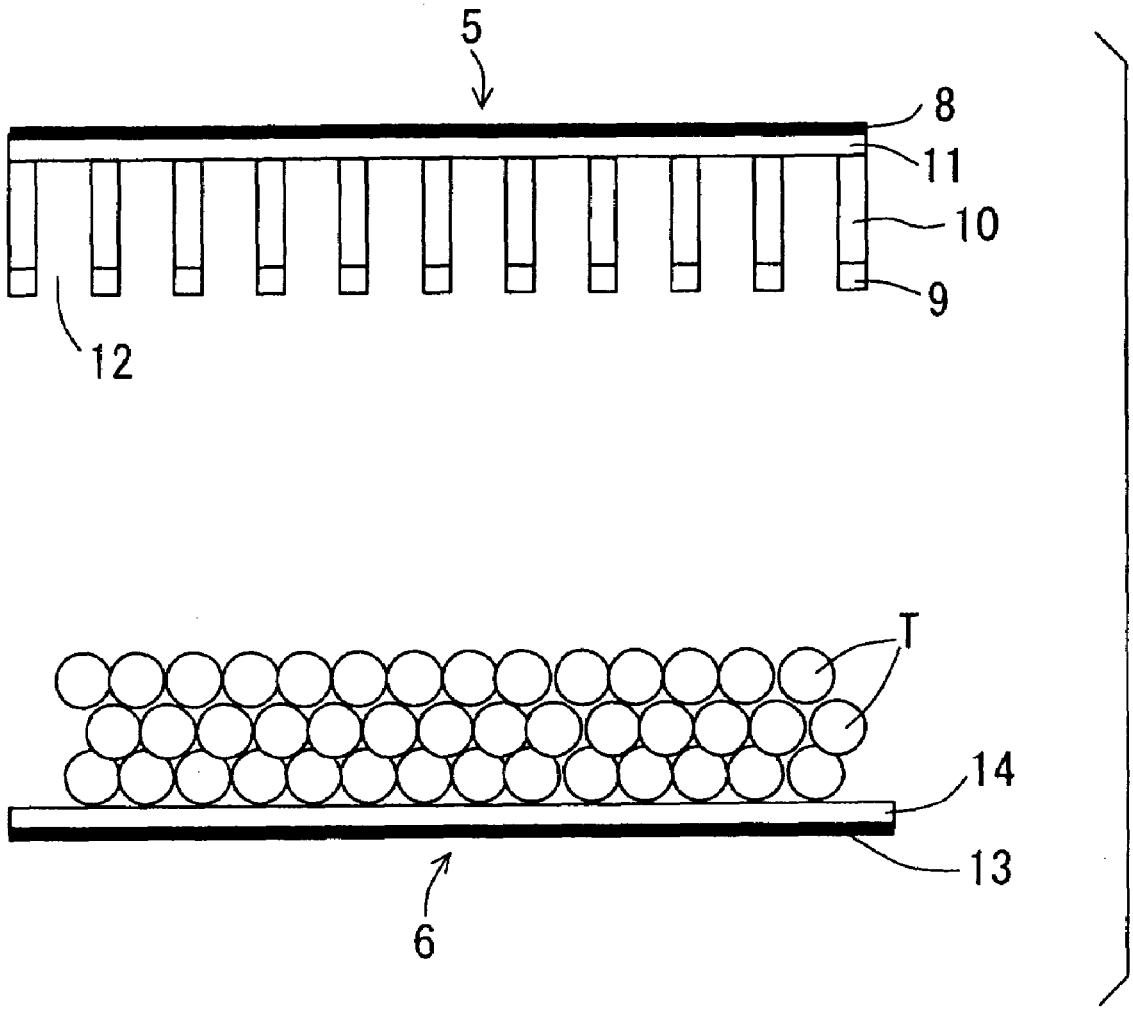
FIG. 2 is a cross sectional view showing a developing roller and a replenishing roller on a position on which both of them are most adjoining with each other.

FIG. 2 is a cross sectional view showing a developing roller 5 and a replenishing roller 6 on a position on which both of them are most adjoining with each other. FIG. 2 shows a state in which replenishing electric field (with developing bias voltage and replenishing bias voltage) for replenishing the toner T is not formed between the developing roller 5 and the replenishing roller 6.

The replenishing roller 6 is provided with an electrode 13 and an electric charge transporting layer 14 and toner T is given by transporting toner T stored in the developing container 7. In addition, as shown in the figure, the toner T is not charged in a state in which neither developing bias voltage nor replenishing bias voltage is applied.

The electrode 13 is an electrode to be used on the occasion of forming replenishing electric field. The electric charge transporting layer 14 is an electric charge amount adjusting means for adjusting an amount of electric charge supplied to conductive toner T on the occasion of forming replenishing electric field. The electric charge transporting layer 14 is a resistance layer and can be easily realized by resistance material using general agent such as for instance carbon black, metal oxide and ion conductive agent.

The developing roller is provided with an electrode 8, a grid electrode (exposed portion) 9, an insulative grid (insulative layer) 10 and a dielectric layer 11, and a concave portion surrounded by the grid electrode 9, the insulative grid 10 and the dielectric layer 11 becomes a toner transporting portion 12 for transporting toner T.

The electrode 8 and the grid electrode 9 configure a pair of grid electrodes and the electrode 8, the grid electrode 9, the insulative grid 10 and the dielectric layer 11 configure toner controlling means.

The electrode 8 is an electrode to be used on the occasion of applying developing bias voltage. The pair of grid electrodes generate desired electric field in a depth direction of a concave portion for the toner transporting portion 12 formed on a surface of the developing roller 5. In this embodiment, grid bias voltage $\Delta V_G$ is applied on a position between the electrode 8 which is the first electrode and the grid electrode 9 which is the second electrode to generate a desired electric field.

Electric charge of toner T can be kept without being missed out to the electrode 8 by the insulative grid 10 and the dielectric layer 11.

The toner transporting portion 12 comprises a concave portion, which keeps toner T supplied from the replenishing roller 6 in a space to adhere to the photoconductor roller 2. A depth of approximately 20 μm to 40 μm is preferable as the depth of the toner transporting portion 12.

In order to form replenishing electric field, direct current voltage $V_{dc}$ and alternating current voltage $V_{ac}$ are applied to the developing roller 5 by the developing bias portion and the voltage applying unit 5*a* which is vibrating means. Therefore, electric potential $V_B$ (developing bias voltage) of the electrode 8 of the developing roller 5 is represented by the following equation.

$$V_B=V_{dc}+V_{ac}$$

In addition, direct current voltage $V_S$ is applied to the replenishing roller 6 by a voltage applying unit 5*b* which is a replenishing bias portion. Electric potential difference $\Delta V_{BS}$ between the developing bias $V_B$ and replenishing bias $V_S$ is represented by the following equation.

$$\Delta V_{BS}=V_B-V_S=V_{dc}-V_S+V_{ac}$$

In addition, grid bias voltage $V_G$ is applied to the developing roller 5 so that direct current electric potential difference $\Delta V_C$ (grid electric potential difference) can be given between the electrode 8 and the grid electrode 9. This makes electric potential $V_G$ of the grid electrode 9 represented by the following equation.

$$V_G=V_B+\Delta V_G$$

In this embodiment, when $V_{dc}$ is equal to −300 V and $V_S$ is equal to −600 V, $V_{ac}$ is equal to $600V_{P\text{-}P}$ (with frequency of 2 kHz) and $\Delta V_G$ is equal to −100 V.

Consequently, $V_G$ and $V_B$ are set respectively by the following equations:

$$V_G=-400\text{ V}+600V_{P\text{-}P}\text{ (with frequency of 2 kHz)}$$

$$V_B=-300\text{ V}+600V_{P\text{-}P}\text{ (with frequency of 2 kHz), and } \Delta V_{BS}\text{ is equal to }-100\text{ V.}$$

In the above-mentioned configuration, the image forming apparatus 1 performs print action according to the following procedure.

First, a manuscript image is read in a manuscript reading apparatus not shown. The photoconductor roller 2*a* is contact with the charging roller 2*b* and is set to a predetermined electric potential and simultaneously rotates at a rotating speed of $v_P$.

The read image data is written in the photoconductor roller 2*a*, for instance, at density of 1200 dpi as an electrostatic latent image S by the laser unit 2*c*.

Toner T is supplied from the developing apparatus 4 and the toner T adheres to electrostatic latent image S. The photoconductor roller 2 transfers toner T on a print sheet P by sandwiching the print sheet between the photoconductor roller 2 and a transfer roller 3*a* on a position on which the photoconductor roller 2 is contact with the transfer roller 3*a*.

And the toner T is fixed in a fixing apparatus not shown and then is delivered to a delivering apparatus not shown.

Figure 3:
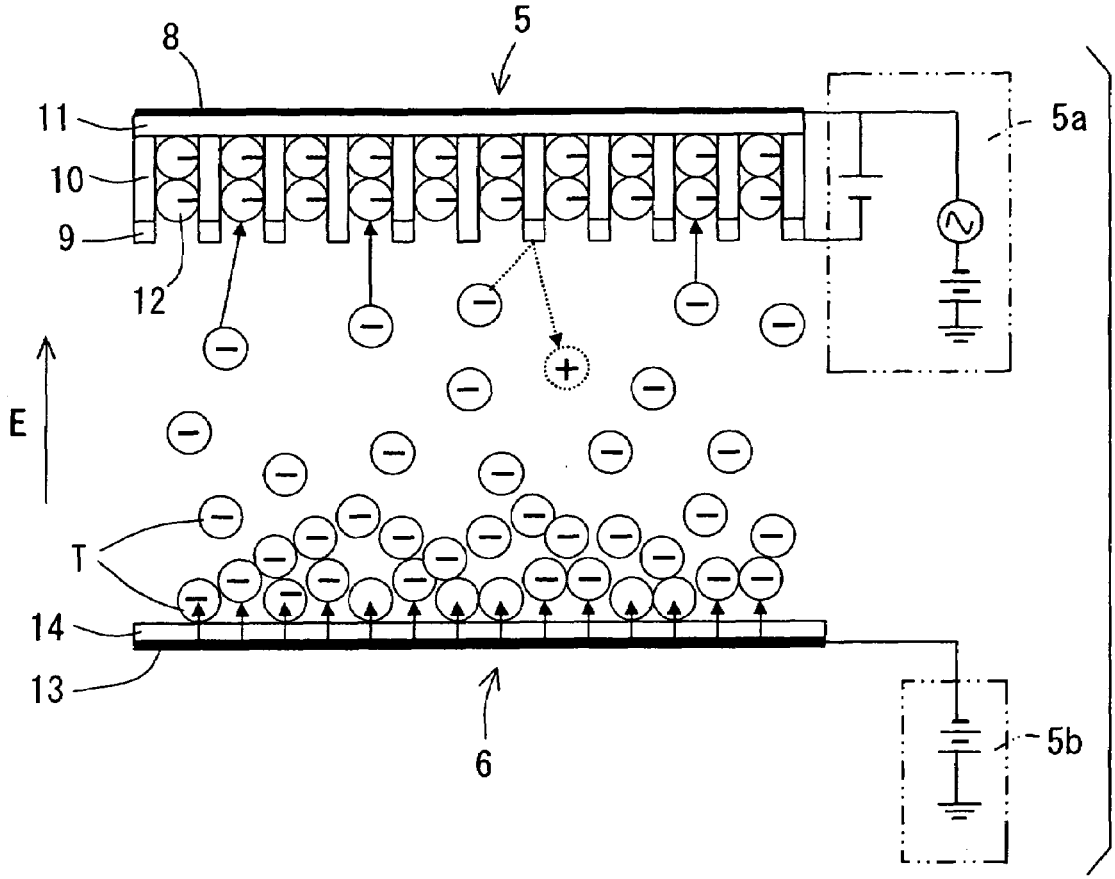
FIG. 3 is a view showing principles of moving toner from the replenishing roller to the developing roller.

Next, detailed description is given about transporting toner T in the developing apparatus 4. FIG. 3 is a view showing principles of moving toner from the replenishing roller 6 to the developing roller 5. The state shown in FIG. 3 is a state in which the above-mentioned replenishing bias voltage is applied to the developing roller 5 and the replenishing roller 6.

As to the replenishing roller 6 and the developing roller located at such position that a distance between the grid electrode 9 of the developing roller 5 and electric charge transporting layer 14 of the replenishing roller 6 can become approximately 100 μm, replenishing bias voltage $V_S$ and developing bias voltage $V_B$ are applied respectively to the electrode 13 of the replenishing roller 6 and the electrode 8 of the developing roller 5 to form replenishing electric potential difference of $\Delta V_{BS}$. Electric field E is generated in a direction from the electrode 8 to the electrode 13 by replenishing electric potential difference $\Delta V_{BS}$. In addition, this replenishing electric potential difference $\Delta V_{BS}$ may be configured so as to be vibrated for a predetermined period and a direction of replenishing electric field E generated between the electrode 13 and the electrode 8 may be changed corresponding to vibration of the electric potential difference $\Delta V_{BS}$.

Toner T on the replenishing roller 6 is charged to negative with a predetermined amount of electric charge by current corresponding to a thickness of the electric charge transporting layer 14. And then the toner T charged to negative receives force F corresponding to a direction of electric field E and flies and moves to the side of the developing roller 5.

The moved toner T is stored and kept in the toner transporting portion 12. Electric field corresponding to the replenishing bias voltage $V_B$ between the electrode 8 and the electrode 13 and electric field generated by grid electric potential difference $\Delta V_G$ between the electrode 8 and the grid electrode 9 are applied to the toner T kept in the toner transporting portion 12. Consequently, force acts on the toner T in a direction from the electrode 13 to the electrode 8 or in a direction from the grid electrode 9 to the electrode 8. This force makes the toner T kept in the toner transporting portion 12.

In addition, in a state in which the charged toner T is kept in the toner transporting portion 12, the toner T is surrounded by the insulative grid 10 and the dielectric layer 11. Consequently, electric charge of the toner T is never leaked into the electrode 8 and this enables the toner T to be stable and kept. In addition, a shape of this toner transporting portion 12 is a predetermined shape which is designed corresponding to a shape of toner T to be transported and an amount of transporting the toner T.

An amount of toner kept in the toner transporting portion 12 is maintained appropriately as follow. As toner T sequentially moves from the replenishing roller 6 to the developing roller 5, electric potential of toner T kept in the toner transporting portion 12 is changed. And when electric potential of toner T kept in the toner transporting portion 12 becomes approximately the same as electric potential of the grid electrode 9, excessive toner T is returned to the replenishing roller 6.

In addition, as shown in FIG. 3, when charged toner $T_a$ is contact with the grid electrode 9 which is an exposed portion, the toner $T_a$ is charged to positive so that electric potential of the toner $T_a$ can be the same as electric potential $V_G$ of the grid electrode 9. This makes this toner $T_a$ moved to the replenishing roller 6. In other words, toner T exceeding a predetermined amount of toner T kept in the toner transporting portion 12, for instance, toner T such as toner Ta exceeding an amount of toner kept in the toner transporting portion 12 is charged to reverse polarity by the grid electrode 9 and is moved to the replenishing roller 6.

Figure 4:
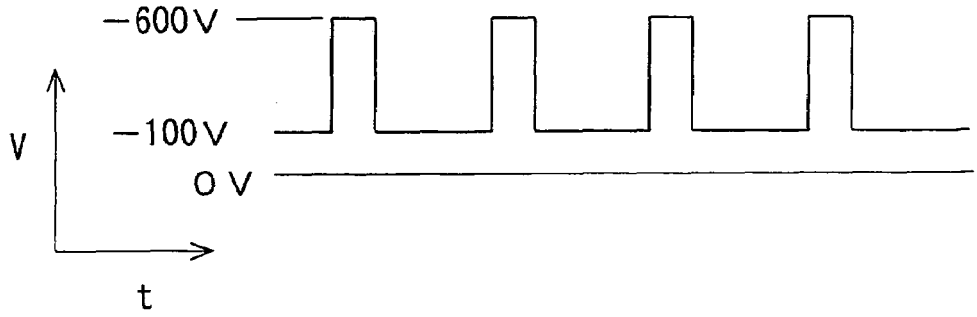
FIG. 4 is a view showing pulse voltage $V_{pul}$.

As mentioned above, the amount of toner T kept in the toner transporting portion 12 is maintained appropriately. In addition, alternating current voltage $V_{ac}$ is applied to the developing roller 5. This makes toner T on the replenishing roller 6 vibrated and makes each particle of toner T adhering to each other by intermolecular force or the like separated to be easily moved to the developing roller 5. In addition, for instance, pulse voltage $V_{pul}$ shown in FIG. 4 can be used instead of such alternating current voltage $V_{ac}$ as mentioned above. This also enables the same effect as obtained in a case of applying alternating current voltage to be obtained. In addition, the vibrating bias voltage is preferably pulse voltage with 10% duty on 1 $KV_P$ in 2.5 kHz period to restrain increase of the whole discharging current followed by alternating current superposition or increase of ozone. Ten percent of the vibrating bias voltage gives vibrating power for movement of the conductive toner and simultaneously remaining ninety percent of the vibrating bias voltage restrains occurrence of ozone.

In addition, the vibrating means may be also means vibrating the replenishing roller 6 mechanically by using, for instance, a piezoelectric element, a magnetic vibrator and a voice coil linear motor or the like instead of change of voltage.

As mentioned above, toner T moves from the replenishing roller 6 to the developing roller 5 and an appropriate amount of toner T is kept in the toner transporting portion 12. Since the developing roller 5 and the replenishing roller 6 without being in contact with each other, rotating torque for rotating the developing roller 5 can be drastically reduced in comparison with conventional configuration.

Figure 5:
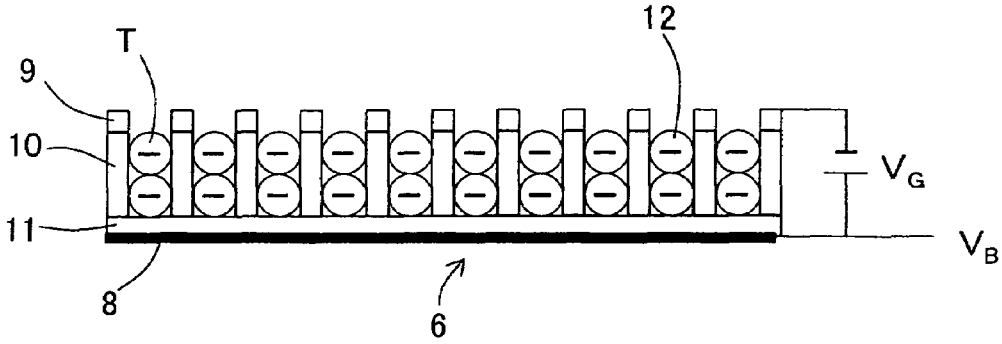
FIG. 5 is a cross sectional view showing a perspective view of a developing roller in a state in which toner is kept.
Figure 6:
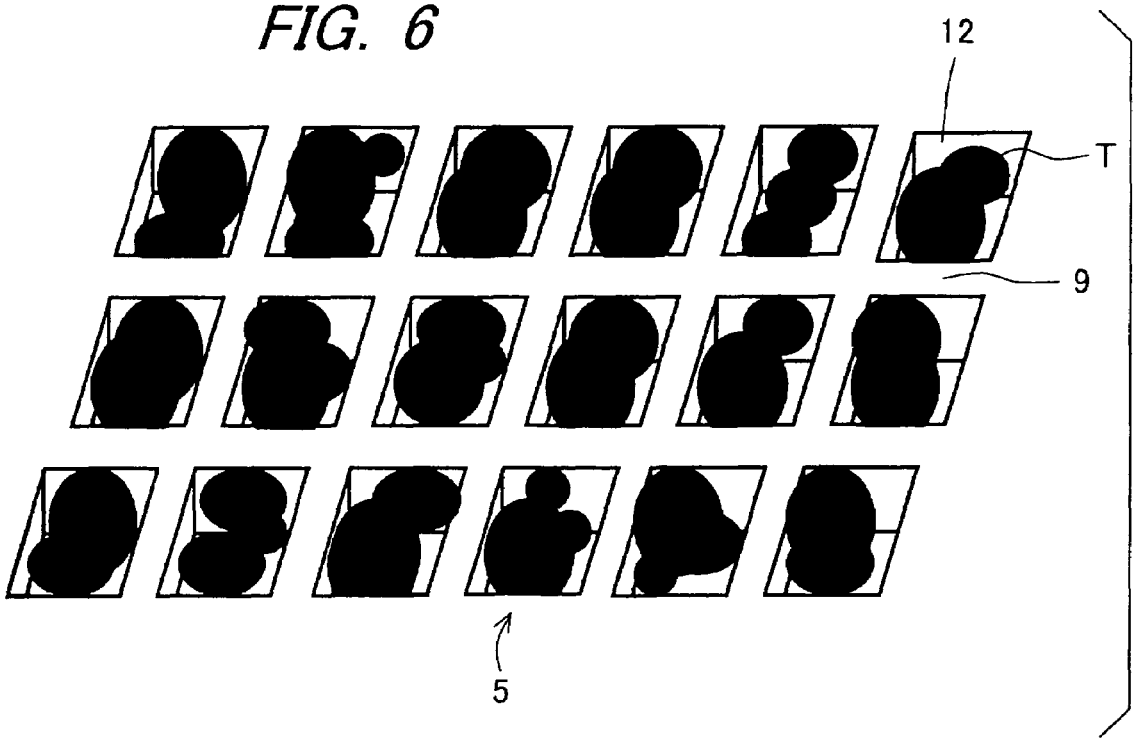
FIG. 6 is a perspective view showing a developing roller 5 in a state in which toner is kept.

FIG. 5 is a cross sectional view showing a perspective view of a developing roller 5 in a state in which toner T is kept. FIG. 6 is a perspective view showing a developing roller 5 in a state in which toner T is kept.

Figure 10:
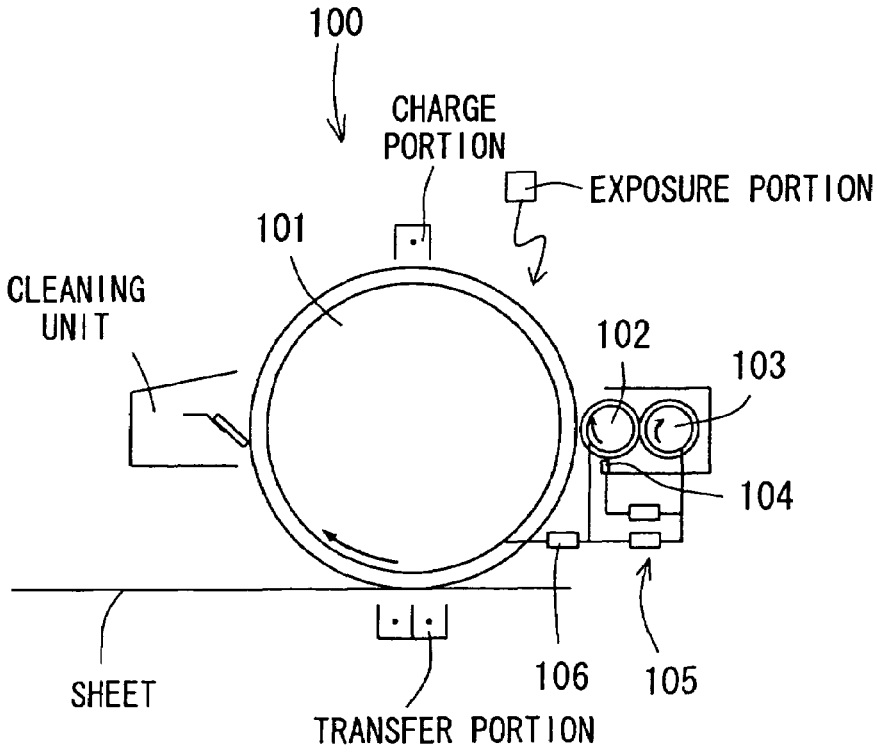
FIG. 10 PRIOR ART
FIG. 10 is a view showing configuration of a conventional image forming apparatus.

As mentioned above, an amount of toner T transported by the developing roller 5 is determined by the toner transporting portion 12. Consequently, there is no necessity of a blade for regulating an amount of toner T as the conventional constitution shown in FIG. 10. In addition, an amount of toner T transported may be adjusted not only by a shape of the toner transporting portion 12 but also, for instance, by an amount of electric charge given to the toner T.

In addition, since toner T is kept in each toner transporting portion 12 and this toner T is supplied to the photoconductor roller 2*a* as mentioned after, an amount of supplying toner to the photoreceptive roller 2*a* can be stable and image quality can be stable.

the following description is given about supplying toner T from the developing roller 5 to the photoreceptive roller 2*a*.

Figure 7:
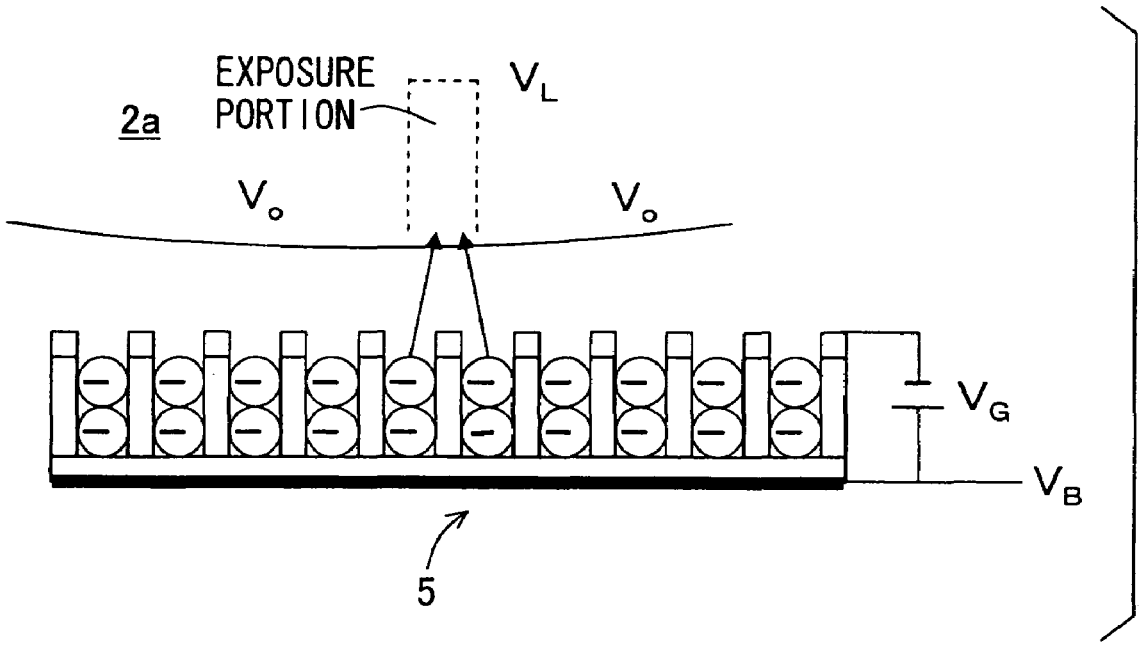
FIG. 7 is a cross sectional view showing the developing roller and a photoconductor roller on a position on which both of them are most adjoining with each other.

FIG. 7 is a cross sectional view showing the developing roller 5 and the photoconductor roller 2*a* on a position on which both of them are most adjoining with each other. The developing roller 5 rotates at a rotating speed of $v_d$ in a state in which toner T is kept in the toner transporting portion 12 and the photoconductor roller 2*a* rotates at a rotating speed of $v_P$. The developing roller 5 and the photoconductor roller 2*a* are located at such position that a distance between a surface of the photoconductor roller 2*a* and the grid electrode of the developing roller 5 can be approximately 100 μm.

Electric potential of the photoconductor roller 2*a* is set to surface electric potential not exposed $V_0$ (=−600 V) for performing reversing development and electric potential of the developing roller 5 is set to developing bias voltage $V_B$.

In addition, grid electric potential difference $\Delta V_G$ between the electrode 8 and the grid electrode 9 is set to a constant value of $\Delta V_G$=−100 V as mentioned above. In addition, as mentioned above, replenishing bias voltage $V_B$ comprises direct current voltage $V_{dc}$ and alternating current voltage $V_{ac}$ vibrating around this $V_{dc}$ which is defined as a center. In other words, replenishing bias voltage $V_B$ vibrates at a value between −1200 V and +800 V.

Toner T is charged to negative and therefore when electric potential $V_L$ (−50 V or less) of the exposure portion on which an electrostatic latent image in the photoconductor roller 2*a* is formed becomes lower electric potential than the developing bias voltage $V_B$, toner T flies and moves to photoconductor roller 2*a*. In addition, relation of each electric potential complies with the following inequality and thereby stable developing can be performed.

$$|V_0|>|V_{dc}|>|\Delta V_G|>|V_L|$$

In a state of FIG. 7, easiness of movement of toner T from the developing roller 5 to the photoconductor roller 2*a* becomes different depending on distance from the developing roller 5 to the photoconductor roller 2*a* and allocation of electric potential on each point of the developing roller 5 and the photoconductor roller 2*a*. To simplify the state, it is presumed that toner T can most easily move on a position on which the developing roller 5 and the photoconductor roller 2*a* are most adjoining with each other. And as to an area in which the toner T moves from the developing roller 5 to the photoconductor roller 2*a* at a rate more than a predetermined rate (10% in this embodiment) for an amount of moving the toner T, the area is called a developing area.

In this embodiment, a width of the developing area is approximately from 5 times to 8 times as wide as that of opening of toner transporting portion 12. Consequently, on the occasion of movement of toner T from the developing roller 5 to the photoconductor roller 2*a*, a position to which the toner T adheres is enabled to become different for each toner and a shape of opening of the toner transporting portion 12 can be sufficiently averaged and a ghost pattern can be eliminated.

In addition, electric potential difference between unexposed surface electric potential $V_0$ and the replenishing bias voltage $V_B$ is applied to a position between the photoconductor roller 2*a* and the developing roller 5. The unexposed surface electric potential $V_0$ is approximately constant. On the other hand, the replenishing bias voltage $V_B$ is changed and therefore changing voltage is applied to a position between the photoconductor roller 2*a* and the developing roller 5. Consequently, mobility of toner T is also changed and thereby a ghost pattern on the photoconductor roller 2*a* can be eliminated.

In addition, in this embodiment, a rotating speed $v_d$ of the developing roller 5 and rotating speed of the photoconductor roller 2*a* are set so as to comply with the following inequality.

$$v_d/v_P \geqq -1.0$$

This enables sufficient toner T to an electrostatic latent image on the photoconductor roller 2*a* to be supplied to prevent lack of toner T.

In addition, in this embodiment, description was given about configuration to which direct current voltage $V_{dc}$ and alternating current voltage $V_{ac}$ are applied as replenishing bias voltage $V_B$, but the invention is not restricted to this configuration. For instance, configuration in which only direct current voltage $V_{dc}$ is applied may be also allowed. In this case, positive voltage comprising only $V_{dc}$ is applied instead of positive voltage comprising combination of $V_{ac}$ and $V_{dc}$.

In addition, as shown in FIG. 1, when a direction of electric field generated by replenishing bias voltage $V_B$ between the electrode 8 of the developing roller 5 and the electrode 13 of the replenishing roller 6 becomes the same as a direction of electric field generated by grid bias voltage $\Delta V_G$ between the electrode 8 of the developing roller 5 and the grid electrode 9, toner T moves from the replenishing roller 6 to the developing roller 5. On the other hand, when a direction of electric field generated by electric potential difference between electric potential of the electrode 8 of the developing roller 5 and electric potential $V_0$ of the photoconductor roller 2*a* becomes inverse for a direction of electric field generated by grid bias voltage $\Delta V_G$ between the electrode 8 of the developing roller 5 and the grid electrode 9, toner T moves from the developing roller 5 to the photoconductor roller 2*a*.

When grid bias voltage $\Delta V_G$ between the electrode 8 of the developing roller 5 and the grid electrode 9 is constant, an amount of electric charge of toner T on the developing roller 5 is kept constant and stable developing can be performed even in a case in which electric potential of the photoconductor roller 2*a* is changed by process control controlling density of toner T, for instance, corresponding to change of temperature or humidity.

Description is given about another embodiment. An image forming apparatus in this embodiment has a different shape of toner transporting portion from the above mentioned image forming apparatus 1 as only one different point. The following description is given only about this different point.

Figure 8:
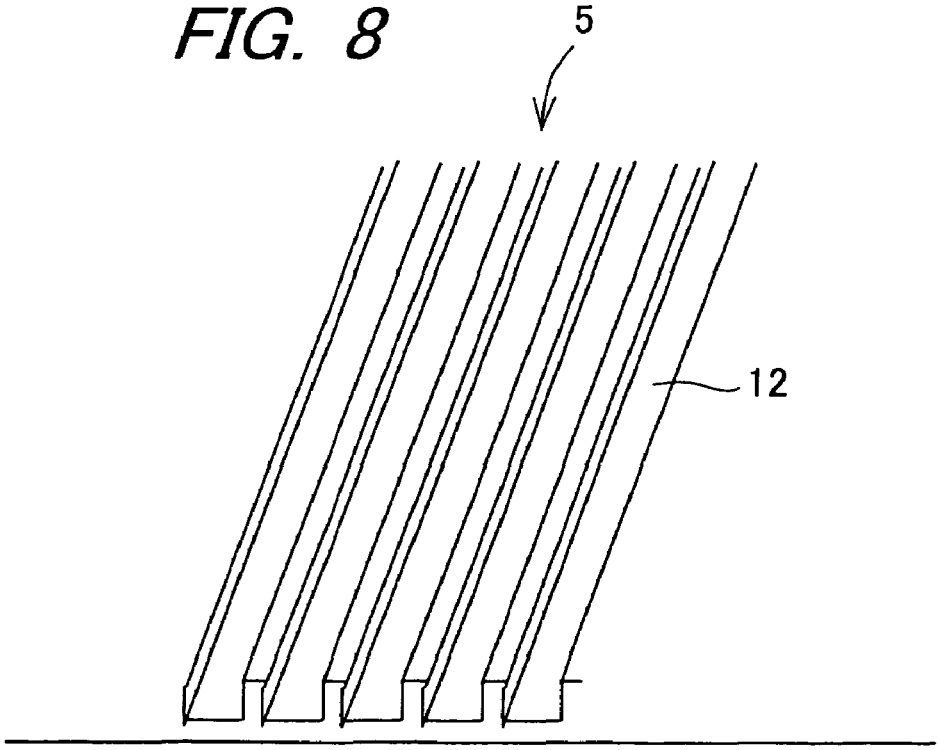
FIG. 8 is a perspective view showing a toner transporting portion formed on the developing roller.

In this embodiment, the toner transporting portion 12*a* formed on the developing roller 5 is a groove shaped concave portion extending linearly in a width direction of the developing roller 5 and arranged at predetermined intervals as shown in the perspective view of FIG. 8.

Figure 9:
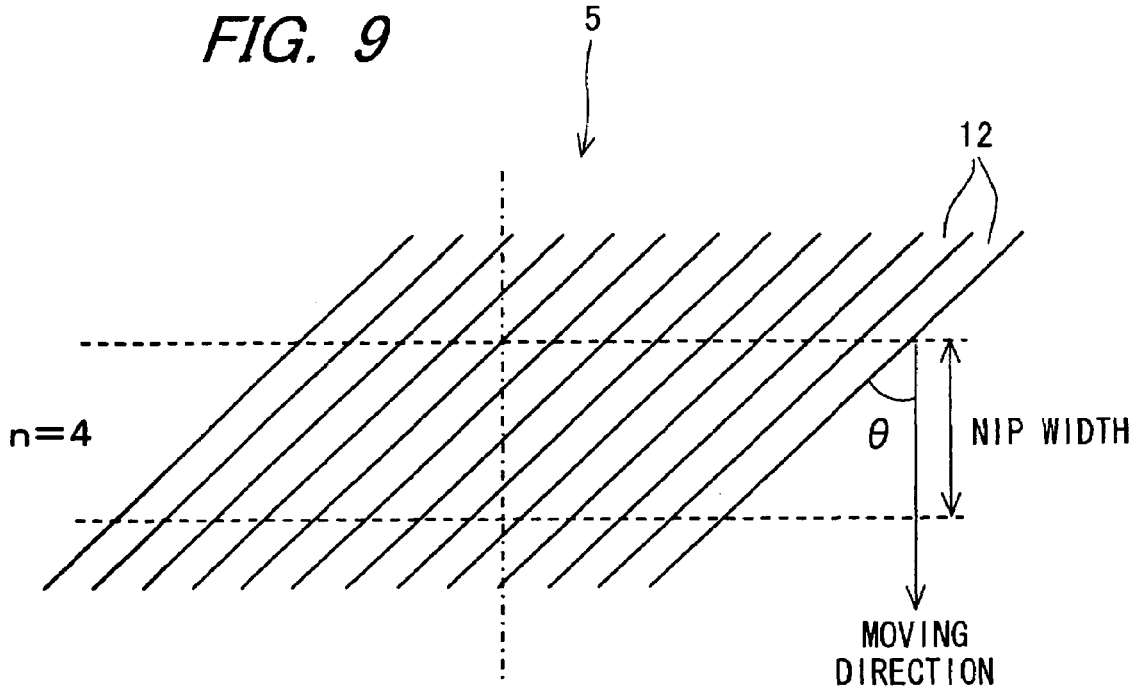
FIG. 9 is a plane view showing the toner transporting portion formed on the developing roller.

In addition, the toner transporting portion 12*a* is tilting at a predetermined angle of θ to a rotating direction of the developing roller 5 as shown in a plane view of FIG. 9. A tilting angle θ is an arbitrary angle except 0 degree and 180 degrees. The developing roller enables ghost pattern corresponding to a shape of the toner transporting portion 12*a* to be eliminated. In addition, It is preferable that effective nip width hold the toner transporting portions 12*a* of as large number N as possible as shown in FIG. 9. In addition, a shape of a concave portion is not restricted to a shape of a groove and even in the case of a shape of grid, the toner transporting portions 12*a* can effectively act by tilting a location angle.

When a peripheral speed of the developing roller 5 is defined as vc (m/s), a peripheral speed of the photoconductor roller 2*a* is defined as vp (m/s), a pitch of the toner transporting portion 12*a* in a moving direction is defined as Xp (m), resolution of an image (or pixel such as dither) in the moving direction is defined as Ip (m), width of developing area in the moving direction is defined as W (m), speed difference Δv complies with the following equation, $$\Delta v = vp - vc$$

and time Tw for which arbitrary point on the photoconductor roller 2*a* passes the developing area complies with the following equation.

$$Tw = W/vp$$

A number N of the toner transporting portions 12*a* which pass an arbitrary point on the photoconductor roller 2*a* in the developing area complies with the following equation:

$$N = abs(\Delta v)Tw/Xp$$

wherein, abs(Δv) is an absolute value of Δv, and N>2, preferably N≧5, more preferably N≧10 is defined to restrain developing unevenness.

In addition, in the case of speed difference is not so great, it is preferable that the following definition is adopted.

Frequency Fc (Hz) of the toner transporting portions 12*a* passing an arbitrary absolute position complies with the following equation.

$$Fc = vp/Xp$$

Pitch Ic (m) of density change caused by this frequency on the photoconductor roller 12*a* complies with the following equation.

$$Ic = Vp/Fc$$

Beat pitch Bp (m) between resolution on the photoconductor roller 2*a* and density change of pitch Ic complies with the following equation:

$Bp=1/abs(1/Ip-1/Ic)$ wherein, $Bp<1\times10^{-3}$, preferably $Bp<0.2\times10^{-3}$ is defined to visually restrain unevenness of beat between the toner transporting portions 12*a* and the resolution in consideration of characteristics of human's visibility In addition, the invention may be provided with the above mentioned configuration and besides the following configuration.

The invention may be provided with configuration in which an interval between the toner transporting portions 12 can be set corresponding to desired resolution. The invention may be also provided with configuration in which width of the toner transporting portions 12 can be set to preferable value corresponding to a particle diameter of toner T. The invention may be also provided with configuration in which depth of the toner transporting portions 12 can be set to a predetermined value larger than the width of the toner transporting portions 12. The invention may be also provided with configuration in which an interval between the developing roller 5 and the replenishing roller 6 or an interval between the developing roller 5 and the photoconductor roller 2*a* can be set to a predetermined preferable value. The invention may be also provided with configuration in which quality of each material configuring the developing roller 5 and the replenishing roller 6 is predetermined quality of material. The invention may be also provided with configuration in which preferable developing action can be performed even in cases of normal developing, contact developing, melting transfer, adhering transfer or the like.

In addition, superposition of alternating current voltage on developing bias voltage is performed for prompting replenishment of toner and is not essential condition and predetermined direct current bias voltage may be used as each bias voltage.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a developing portion for supplying conductive toner to a photoconductor portion in which an electrostatic latent image is formed; and a replenishing portion for replenishing the conductive toner stored in a developing container to the developing portion, the photoconductor portion and the developing portion as well as the developing portion and the replenishing portion being relatively moved, wherein the developing portion and the replenishing portion are located at a predetemined interval without being in contact with each other, wherein the developing apparatus is provided with a replenishing bias portion for applying replenishing bias voltage to the developing portion and the replenishing portion, and wherein when the replenishing bias portion applies replenishing bias voltage, conductive toner kept on a surface of the replenishing portion is charged and then the charged conductive toner moves from the replenishing portion to the developing portion by electric field generated between the developing portion and the replenishing portion to be replenished.

2. The developing apparatus of claim 1, wherein the replenishing portion is provided with electric charge amount adjusting means for adjusting an amount of electric charge which is supplied to the conductive toner.

3. The developing apparatus of claim 2, wherein the electric charge amount adjusting means is made of a resistance layer.

4. The developing apparatus of claim 1, further comprising vibrating means for vibrating the conductive toner kept in the replenishing portion.

5. The developing apparatus of claim 4, wherein the vibrating means is configured so as to superpose vibrating bias voltage on the replenishing bias voltage.

6. The developing apparatus of claim 1, wherein the developing portion is provided with a concave portion formed on the whole surface of the developing portion and keeps the conductive toner moved from the replenishing portion in the concave portion and supplies the conductive toner to the photoconductor portion.

7. The developing apparatus of claim 6, wherein the concave portion is provided with a pair of grid electrodes for applying grid bias voltage generating electric field in a depth direction of the concave portion.

8. The developing apparatus of claim 7, wherein the pair of grid electrodes includes a first electrode formed on a bottom portion of a convace portion and a second electrode exposed and formed in an area except the concave portion and grid bias voltage is applied to a position between the first electrode and the second electrode.

9. The developing apparatus of claim 7, wherein a constant grid bias voltage is applied to the pair of grid electrodes.

10. The developing apparatus of claim 6, wherein:

the convace portion is arranged at a predetermined interval on the surface of the developing portion, and an arrangement direction of the concave portion is tilted at a predetermined angle with respect to a moving direction of the surface of the developing portion.

11. The developing apparatus of claim 10 wherein:

the photoconductor portion is formed of a photoconductor roller which rotates around an axis line of a rotating shaft, the developing portion is formed of a developing roller which rotates around an axis line of a rotating shaft parallel to the rotating shaft of the photoconductor roller, the photoconductor roller and the developing roller are arranged at a predetermined interval without being in contact with each other, and circumferential speed of the developing roller is larger than circumferential speed of the photoconductor roller.

12. The developing apparatus of claim 1, wherein the developing apparatus is provided with a developing bias portion for applying developing bias voltage between the developing portion and the photoconductor portion, and the developing bias portion temporally makes the developing bias voltage change.

13. An image forming apparatus comprising:

a photoconductor portion on whose surface an electrostatic latent image is formed;

a writing portion for writing the electrostatic latent image on the photoconductor portion on the basis of image data;

the developing apparatus of claim 1 for supplying toner to the photoconductor portion to form a toner image;

a transfer portion for transferring the toner image on a sheet-like recording medium; and a fixing portion for fixing the transferred toner image on the recording medium.

14. A toner replenishing method by which a replenishing portion being located at a predetermined interval without being in contact with a developing portion which supplies conductive toner to a photoconductor portion on which an electrostatic latent image is formed, replenishes conductive toner stored in a developing container to the developing portion, comprising:

applying replenishing bias voltage to the developing portion and the replenishing portion;

charging the conductive toner kept on the surface of the replenishing portion; and moving the charge conductive toner from the replenishing portion to the developing portion by electric field generated between the developing portion and the replenishing portion on the basis of the applied replenishing bias voltage to replenish.

15. The toner replenishing method of claim 14, wherein:

the developing portion is provided with a concave portion formed on the whole surface of the developing portion and keeps the conductive toner moved from the replenishing portion in the concave portion and supplies the conductive toner to the photoconductor portion, the concave portion is provied with a pair of grid electrodes, and the pair of grid electrodes generates electric field in the depth direction of the convace portion by applying grid bias voltage so as to adjust an amount of charge of the conductive toner kept in the concave portion.

16. The toner replenishing method of claim 14, wherein:

the developing portion is provided with a concave portion formed on the whole surfce of the developing portion and keeps the conductive toner moved from the replenishing portion in the concave portion and supplies the conductive toner to the photoconductor portion, the concave portion is provided with a pair of grid electrodes, and the pair of grid electrodes generates electric field in the depth direction of the concave portion by applying grid bias voltage so as to adjust a keeping amount of the condcutive toner kept in the concave portion.

17. The toner replensihing method of claim 14, wherein conductive toner replenished excessively from the replenishing portion to the develoing portion moves to the replenishing portion by electric field generated by the replenishing bias voltage.

18. A developing apparatus comprising:

a developing portion for supplying conductive toner to a photoconductor portion in which an electrostatic latent image is formed; and a replenishing portion for replenishing the conductive toner stored in a developing container to the developing portion, the photoconductor portion and the developing portion as well as the developing portion and the replenishing portion being relatively moved, wherein the developing portion and the replenishing portion are located at a predetermined interval without being in contact with each other, wherein the developing apparatus is provided with a replenishing bias portion for applying replenishing bias voltage to the developing portion and the replenishing portion, and wherein when the replenishing bias portion applies replenishing bias voltage, conductive toner, which is not charged by friction, kept on a surface of the replenishing portion is charged and then the charged conductive toner moves from the replenishing portion to the developing portion by electric field generated between the developing portion and the replenishing portion to be replenished.

19. A toner replenishing method by which a replenishing portion being located at a predetermined interval without being in contact with a developing portion which supplies conductive toner to a photoconductor portion on which an electrostatic latent image is formed, replenishes conductive toner stored in a developing container to the developing portion, comprising:

applying replenishing bias voltage to the developing portion and the replenishing portion;

charging the conductive toner, which is not charged by friction, kept on the surface of the replenishing portion; and moving the charged conductive toner from the replenishing portion to the developing portion by electric field generated between the developing portion and the replenishing portion on the basis of the applied replenishing bias voltage to replenish.

* * * * *